United States Patent [19]

Lowery, Sr. et al.

[11] Patent Number: 4,744,144

[45] Date of Patent: May 17, 1988

[54] OSCILLATING RAZOR

[75] Inventors: Charles M. Lowery, Sr., Bastrop; Jimmie George, Mer Rouge, both of La.

[73] Assignee: Wellington Investments, Inc., Dallas, Tex.

[21] Appl. No.: 847,305

[22] Filed: Apr. 2, 1986

[51] Int. Cl.[4] ..... B26B 21/38

[52] U.S. Cl. ..... 30/45; 30/DIG. 1

[58] Field of Search ..... 30/32, 34.2, 42, 44, 30/45, 51, DIG. 1

[56] References Cited

U.S. PATENT DOCUMENTS

| | | | |
|---|---|---|---|
| 2,054,418 | 9/1936 | Bohm | 30/45 |
| 2,112,402 | 3/1938 | Jaffe | 30/44 |
| 3,611,568 | 10/1971 | Alexander et al. | 30/45 |
| 3,636,627 | 1/1972 | Tiffin | 30/45 |
| 3,772,779 | 11/1973 | Douglass et al. | 30/45 |
| 4,509,259 | 4/1985 | Kakumoto et al. | 30/34.1 |

*Primary Examiner*—E. R. Kazenske
*Assistant Examiner*—Michael D. Folkerts
*Attorney, Agent, or Firm*—Stephen D. Carver

[57] ABSTRACT

A hand held, oscillating razor for wet shaving which comprises an internally operated eccentric for forcibly, rapidly vibrating the cutting blades. Preferably the razor comprises an elongated, generally tubular housing adapted to receive a carriage which mechanically secures a rotatable eccentric, a motor for rotating the eccentric, and an associated angularly tilted battery which powers the motor. A receptacle integrally associated with the neck of the housing is adapted to removably receive a standard blade cartridge for shaving. The razor exhibits a characteristic resonant frequency, and its center of mass lies apart from its central axis, so that the razor characteristically displays a dynamic couple in operation. The motor rotates within a speed range of between 1.414 and two times the natural resonant frequency of the razor so as effectuate as comfortable a shave as possible. Within this range razor shaving characteristics are substantially unaffected by the mode or manner in which the unit is held. The transmissibility operating point and the roll couple attributes of the unit insure that the razor exhibits uniform shaving characteristics substantially independently of the manner in which it may be held by the user.

12 Claims, 6 Drawing Sheets

FIG. 14 A
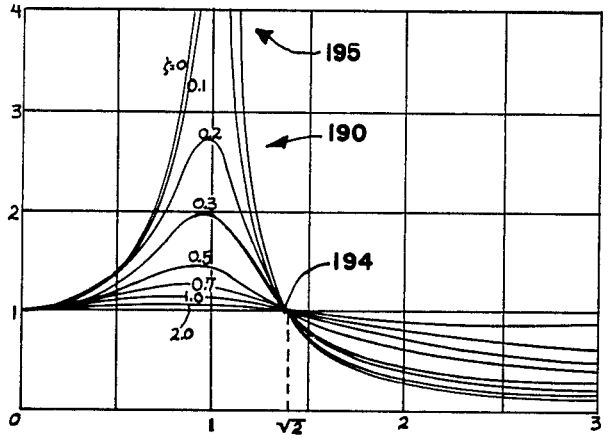
FIG. 14 B
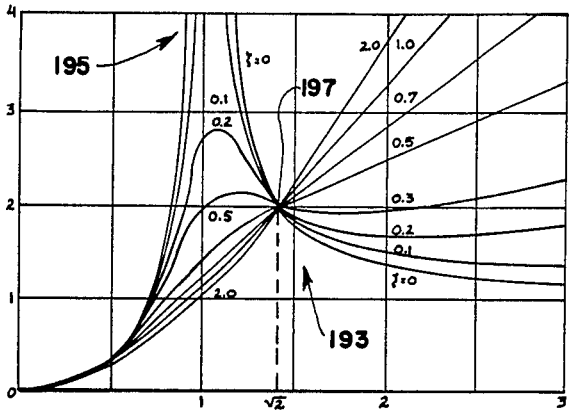
FIG. 16
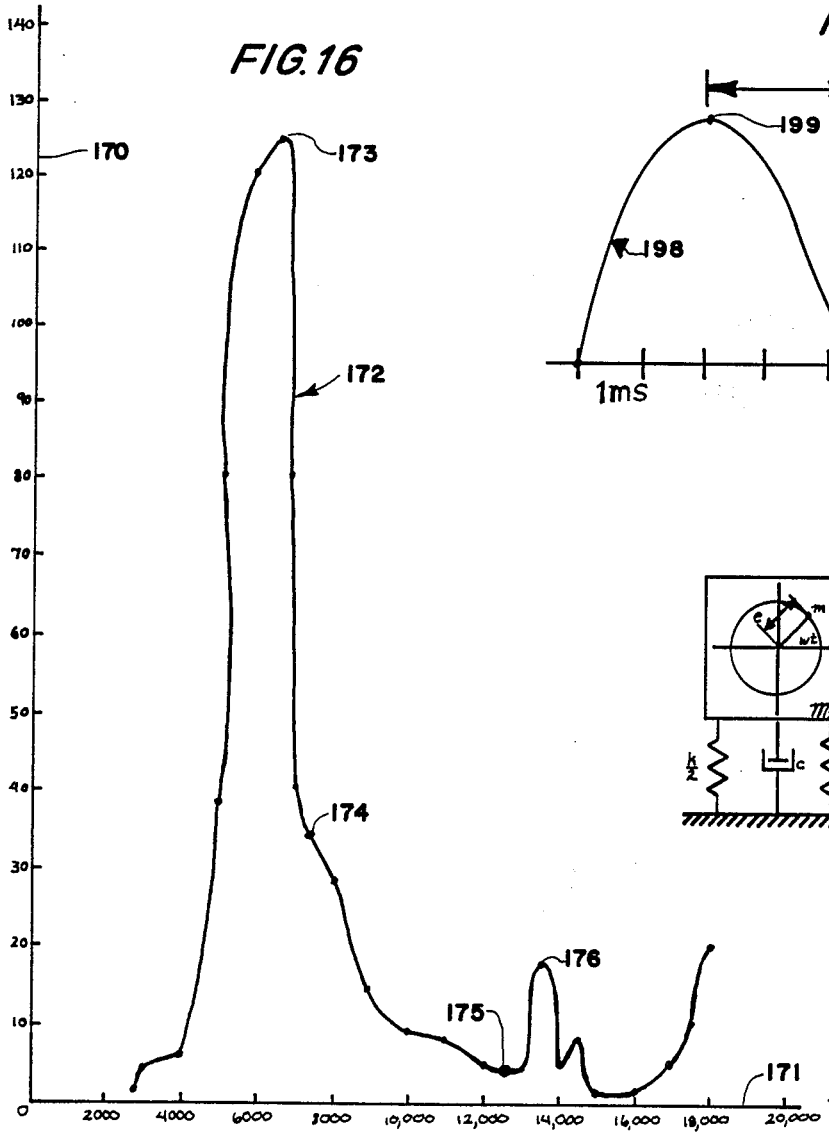
FIG. 15
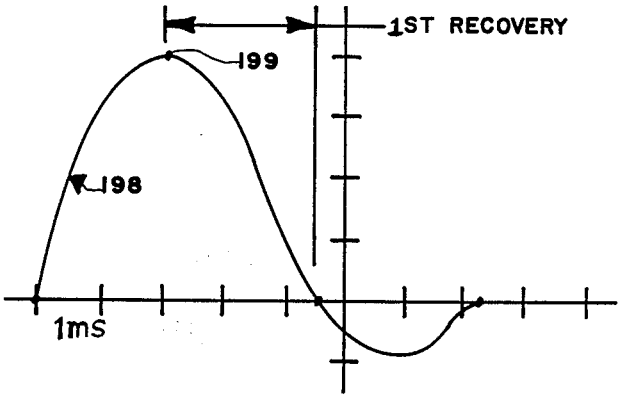
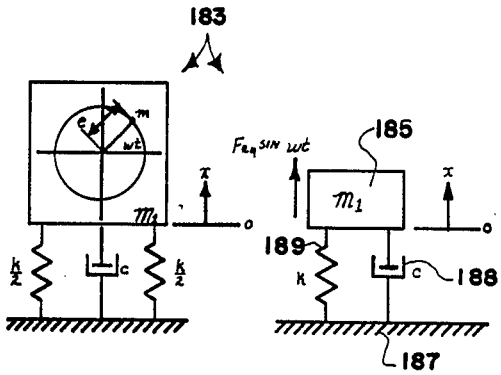
FIG. 13

PRIOR ART 3,611,568
B.H. ALEXANDER et.al.
OCT. 12, 1971

PRIOR ART 3,636,627
TIFFIN
JAN. 25, 1972

PRIOR ART 3,772,779
DOUGLASS & KOEHLER
NOV. 20, 1973

OSCILLATING RAZOR

BACKGROUND OF THE INVENTION

The present invention relates generally to electrical wet shaving devices. More particularly, the present invention relates to battery powered, oscillating razors in which an internally disposed eccentric mass is rapidly rotated to forcibly vibrate the shaver cutting blade or blades.

It will be well appreciated that a comfortable shave is highly desirable. The prior art suggests that the employment of a rotating mass within a hand-held wet shaver has been found desirable to increase shaving comfort. A plurality of prior art shavers exist in which an internal battery is disposed for rotating a motor-driven eccentric to produce vibration.

One of the most relevant prior art U.S. patent references known to us disclosing the broad teachings of this general concept is seen in U.S. Pat. No. 2,054,287, issued to Bohm, in Sept. 1936. Bradshaw in U.S. Pat. No. 860,849 discloses a cam and spindle mechanism for reciprocating a cutting blade. Bohm suggests a safety razor having an internal eccentric driven by an associated motor. Similar prior art U.S. patents include Tiffin, No. 3,636,627; Douglas, No. 3,772,779; Alexander, No. 3,611,568, and Jaffe, No. 2,112,402. The latter reference includes electrical and mechanical structure driving and rotating an oscillating mass for producing vibration. U.S. Pat. No. 1,798,831 issued to Brazeal discloses a safety razor having means for producing movement on a diagonal path of travel to produce a shear cut in an effort to promote efficiency. U.S. Pat. No. 2,552,688 issued to H. F. Partridge discloses a vibrating safety razor which includes a lever and crank apparatus for reciprocating the razor and blade in short, swift strokes to effect a lateral vibration of the blade as it is drawn over the face of a user. This patent differs from the Bradshaw and Brazeal patents in that it is drawn to a device which effects motion to both the razor and the blade, rather than to the blade and blade head only.

Most of these patents exhibit a means for vibrating a cutting surface during wet shaving in which an internal vibratory system is employed to rapidly oscillate the cutting surface. Jaffe discloses a wind-up spring-operated motor drives a rotatable eccentric including a spindle carrying a rotatable pendulum. Alexander discloses a basic system in which a battery spaced apart from a motor drives a rotatable eccentric to provide vibration. A similar prior art approach is exhibited by Tiffin.

Other prior art patents of possible relevance comprise Design Pat. Nos. 150,439; D211,553; D161,675; and D254,209. The prior art structure of U.S. Design Pat. No. D279,930, was invented previously by one of the same inventors as in the instant case. Also of possible relevance are U.S. Utility Pat. Nos. 2,904,883; 3,610,080; 1,719,827; 3,131,974; 2,230,630; 2,227,996; 2,609,602; 2,423,595; 3,038,254.

All of the relevant prior art oscillating wet shaver references known to us disclose structure including a housing having a longitudinal axis which is substantially coincident with the axis of mass of the internally disposed battery power supply. Such devices do not exhibit sufficient dynamic coupling (i.e. "roll-couple") as does the present invention. Moreover, the prior art teaches that rotational velocity of the motor, depending on the dampening qualities of the device, should be effectuated so as to produce operation at a point which is most electrically efficient. As will be appreciated by those familar with mechanical engineering resonance concepts, devices, such as the razors aforedescribed, exhibit a characteristic mechanical period of vibration, and thus are characterized by a resonance.

In mechanical systems having one degree of freedom which are subjected to forced, dampened vibration, the ratio of transmitted force to impressed force follows a well-defined and widely discussed relationship with applied frequency. The best understood characteristic is operation at the "critical speed" of the system wherein transmitted forces peak at relatively high multiples of impressed force. The frequency ratio at the critical speed is 1, by definition. A less widely-understood characteristic is system behavior at frequencies above 1.414 (i.e., the square root of 2) in which a not insubstantial degree of dampening may cause the transmitted force to be very high multiple of impressed force. Critical speed phenomena will therefore be observed in only a very narrow speed range, wherein the latter transmitted force ratio continues to increase with increasing speed in a predictable manner.

For purposes of energy efficiency prior art devices broadly relate the frequency of eccentric oscillation to correspond generally with the characteristic resonance of the device. Thus the "frequency ratio" which relates the motor speed to the characteristic mechanical resonance of the device, has been as close as possible to unity (i.e. 1) in prior art devices. As will be recognized by those skilled in the mechanical engineering arts, frequency ratios in dampened oscillating systems can be graphically related to such characteristic phenomena as transmissibility, which may be broadly defined as the ratio of resulting force to impressed force. A graph plotting frequency ratio against transmissibility illustrates the effects of dampening. Speed ratio and resonance are related to the concept of dampening in a mechanical, vibratory system. Such curves are used to characterize dampened vibrating mechanical systems, and it has previously been thought that eccentrically vibrating razors should operate at a motor speed relatively close to that rotational frequency which corresponds to a maximum transmissibility.

We have recognized the desirability of providing a vibratory razor system which effectuates a frequency ratio above 1.414. Means have been provided, therefore, to effectuate an observed frequency ratio above this "square root of two" limit. Moreover, due to the location of the center of gravity and its offset from the longitudinal center of mass and the axis of the handle, we have determined that a better cutting phenomena occurs through the concept of roll-couple. In other words, we have found it desirable to provide a microscopic, orbital motion upon the cutting edges of the razor which do not exhibit a uniform orbit across the plane of the cutting blades.

It is also extremely important to provide a razor which is relative mechanically insensitive to the manner in which it is held. An effective shaver will encounter a material (e.g., hair) of constantly changing properties. Not only is one person's hair different from another's, the hair on the chin is different from hair on the cheek, and the differences change with time. The frequency applied must take advantage of the skin's normal spring-dampening characteristics to insure vibration above the system's critical frequency. Unless the rotational speed and internal construction of vibratory razor devices are appropriately designed, the force transmittal characteristics and hence the shaving efficiency and comfort, will be deleteriously affected in response to the manner in which the razor is gripped or held during shaving. Hence it is desirable to provide a razor of the general characteristics described which is relatively insensitive to the manner in which it is held by the user.

Thus prior art oscillating razor references have previously employed a rotation speed which apparently maximizes energy efficiency and effectuates the widest possible magnitude of blade displacement, operating at a frequency ratio very close to unity. Among other things, we have discovered that for purposes of maximizing comfort it is desirable for an oscillating razor to operate at a frequency ratio of between 1.414 and 2.0, notwithstanding the fact that theoretical electrical motor efficiency may be sacrificed somewhat. Shaving comfort is related more to transmitted force than to amplitude. When motor speeds exceed the second harmonic (i.e. twice the natural resonant frequency of the razor device when hand held), comfort is reduced. We have also determined that it is desirable for such a device to exhibit a roll couple.

SUMMARY OF THE INVENTION

The present invention comprises a hand-held, oscillating wet shaving device adapted to be employed with a conventional, replaceable twin blade. The razor device exhibits extreme insensitivity to the manner of holding by the shaver. Its functional attributes are effectuated through the employment of an internal, high-speed rotating eccentric, which ideally operates at a speed approximately greater than 1.414 times the resonant frequency of the device.

Preferably the invention comprises a generally tubular, elongated, rigid housing of molded plastic. The housing is generally in the form of a truncated cone and it extends from a lower, relatively larger diameter portion to a smaller diameter, integral neck which is integrally associated with a receptacle upon which a conventional cutting element may be replaceably disposed. A carriage, which is adapted to be snap-fitted into the housing, extends from a lower base, which operationally seals the housing, and the carriage operatively, mechanically mounts the motor which drives an eccentric. An internal, rechargeable battery is also mounted upon the carriage for powering the motor. In the best mode the battery axis is angulated or tilted with respect to the longitudinal axis of the apparatus, and this orientation of the battery mass effectuates a dynamic roll-couple.

Preferably an electrical reed switch operatively associated with the carriage electrically interconnects the battery power supply with the motor. The housing includes an external, slidable magnetic switch which may be manually axially displaced by the shaver to close the reed switch contacts, whereby to energize the shaver. When the carriage is fitted to the housing, suitable seals are compressed to provide a watertight enclosure. In this manner, the electrical apparatus within the housing secured by the carriage is substantially waterproofed.

Thus a fundamental object of the present invention is to provide an oscillating razor of the characteristics described which will produce a very comfortable shave.

A similar fundamental object of the present invention is to provide an oscillating razor of the character described which is adapted to shave closely and comfortably without irritating the skin.

Yet another object of the present invention is to provide an oscillating razor of the character described which exhibits substantially uniform shaving characteristics independently of the mode or manner in which it is held.

Another object of the present invention is to provide a vibrating shaver in which the observed orbital traces of the blade cutting surfaces are substantially consistent independently of the mode or manner in which the device is held during shaving by the user.

A similar object of the present invention is to provide an oscillating razor of the character described which exhibits a roll-couple.

Yet another object of the present invention is to provide a shaver of the characteristics broadly recited above which exhibits a frequency ratio approximately between 1.414 (i.e. the square root of two) and two.

Yet another object of the present invention is to provide an oscillating razor of the character described in which the center of mass of the handle is offset from the longitudinal axis thereof.

Another object of the present invention is to provide an oscillating razor of the character described which operates at a relatively high vibrational speed to provide uniform shaving consistency and operation independent of the manner or mode in which it is held.

A still further object of the present invention is to provide an oscillating razor of the character described in which the rotating mass is disposed as closely as possible to the cutting edge, but which includes a center of mass offset from the longitudinal axis thereof.

A similar further object of the present invention is to provide a battery-driven oscillating razor of the character described which makes the blade displacement more closely parallel to the cutting blades whereby to produce a more comfortable shave.

These and other objects of the present invention along with the features of novelty appurtenant thereto will appear or become apparent in the course of the following description sections.

BRIEF DESCRIPTION OF THE DRAWINGS

In the following drawings, which form a part of the specification and which are to be construed in conjunction therewith, and in which like reference numerals have been employed throughout wherever possible to indicate like parts in various views:

FIG. 13 is mechanical schematic diagram generally illustrating an unbalanced mechanical system;

FIG. 14A is a graph plotting transmissibility against frequency ratio for the rotating unbalanced mechanical system shown generally in FIG. 13, illustrating various damping factors;

FIG. 14B is a graph similar to FIG. 14A plotting force ratio against frequency ratio for the system of FIG. 13;

FIG. 15 is a graph plotting the representative period determined from design tests of the subject razor, wherein the natural resonant frequency of a sample razor was determined;

FIG. 16 is a graph plotting shaver blade edge displacement as a function of motor oscillating frequency, illustrating the preferred operating range of the present invention along with the resonance characteristics thereof;

DETAILED DESCRIPTION OF THE DRAWINGS

Figure 1:
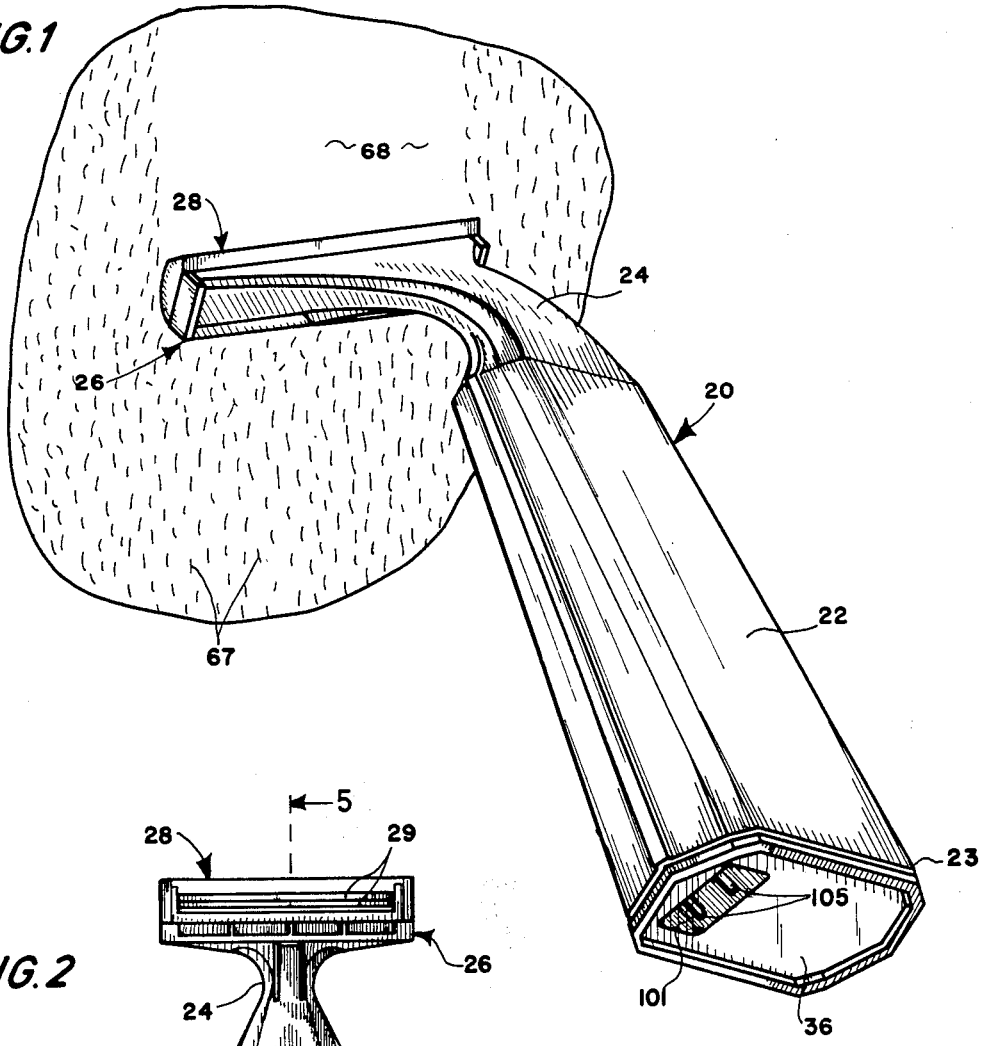
FIG. 1 is a fragmentary, pictorial view illustrating an oscillating razor constructed in accordance with the best mode of the present invention in use shaving the skin of the user.

With initial reference directed now to FIG. 1 of the appended drawings, an oscillating razor constructed in accordance with the best mode of the present invention has been generally designated by the reference numeral 20.

Razor 20 includes a rigid, elongated, generally tubular housing 22 extending from a lower, relatively larger diameter bottom generally indicated by the reference numeral 23. The housing 22 gradually increases in dimensions and extends toward an upwardly curved integral neck portion 24 which terminates in a suitable receptacle 26 adapted to removably receive a conventional, removable twin blade cutter element 28. As will be appreciated from an inspection of FIGS. 1–3, the housing 22 is generally in the form of a truncated pyramid or cone, and it will be observed that the lower bottom 23 is generally the largest dimensioned portion thereof.

Figure 6:
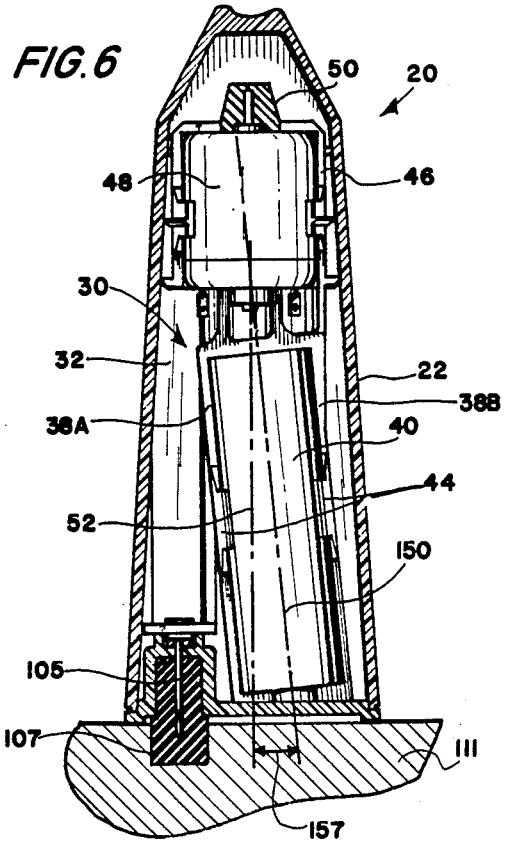
FIG. 6 is a rear fragmentary, sectional view thereof, taken generally along line 6—6 of FIG. 3 showing a portion of the optional recharger.
Figure 7:
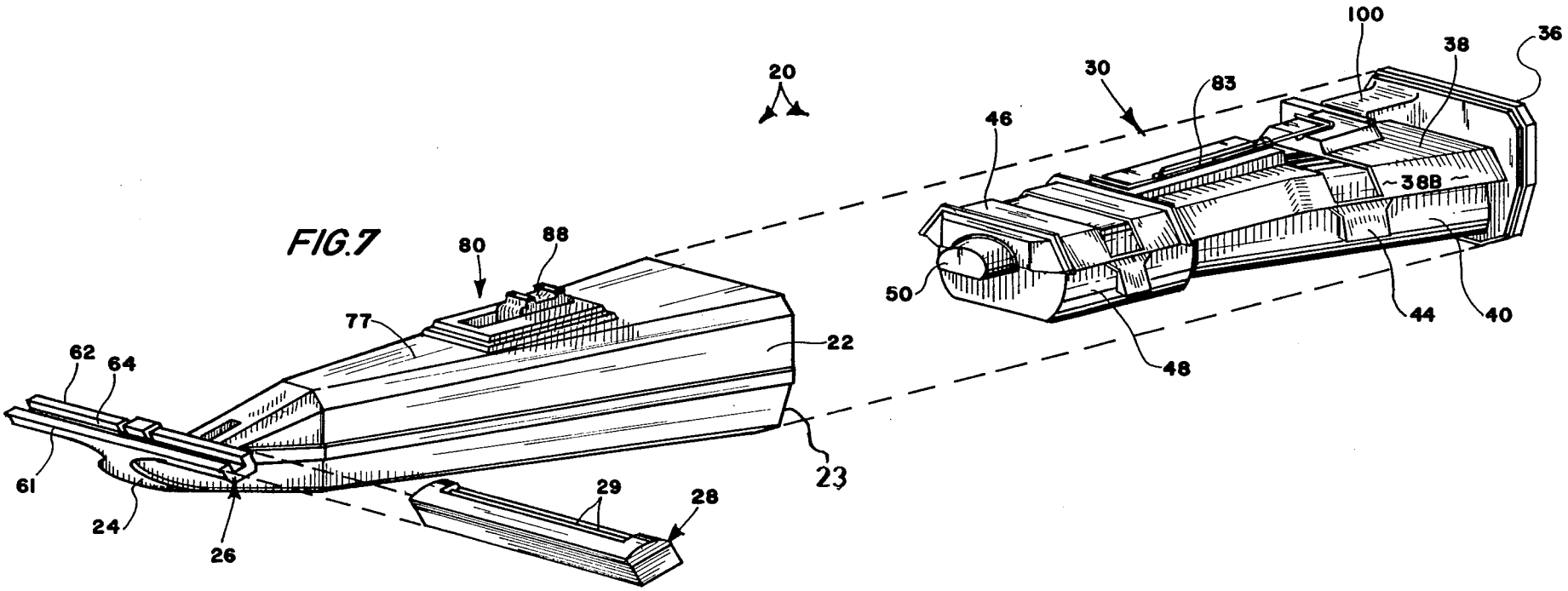
FIG. 7 is an enlarged scale, exploded isometric view of the best mode of the present invention.

As seen in FIG. 7, the razor 20 includes an internal carriage, generally designated by the reference numeral 30, which is adapted to be fitted within the hollow, elongated interior 32 of the razor 20. The lower base 36 of the carriage 30 integrally supports an upwardly projecting mounting portion 38, which is adapted to snugly secure a conventional, generally cylindrical battery 40. This mounting surface 38 is of generally semicircular vertical cross-section, and it includes a pair of sides 38A and 38B (FIG. 6), which are adapted to surround and firmly, yieldably grip battery 40 to secure it in an operative position. The battery is further secured by a pair of integral tabs 44 which abut the battery on opposite sides thereof (FIG. 6).

Figure 8:
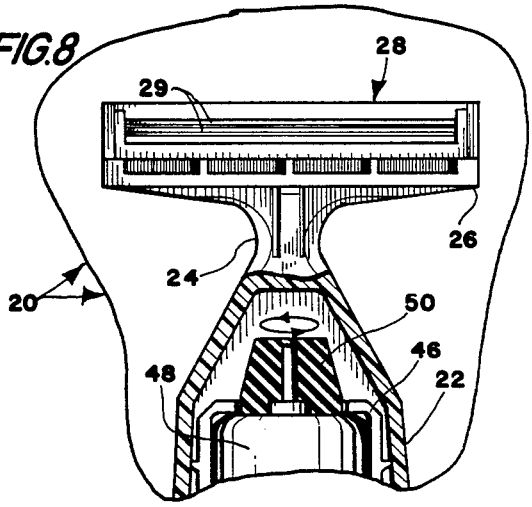
FIG. 8 is an enlarged, fragmentary, front plan view of the upper portion of the razor, with portions thereof broken away or shown in section for clarity.
Figure 9:
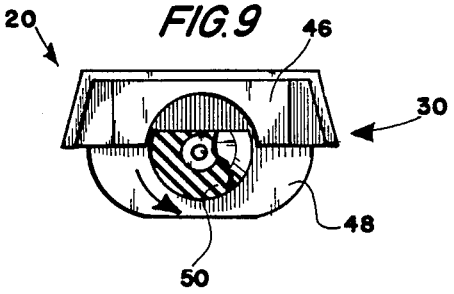
FIG. 9 is an enlarged, fragmentary, top plan view of the razor, with portions thereof broken away or shown in section for clarity.

Carriage member 38 is integral with an upper housing portion 46 adapted to permanently secure a suitable motor 48 which drives an eccentric 50 to produce vibration. As best viewed in FIG. 11, the axis of rotation has been generally identified by the reference numeral 52, and this axis is coincident with the center of the motor 48 (FIG. 8). The longitudinal axis 52 (FIG. 11) is substantially coincident with the section lines 6 of FIG. 3.

Figure 3:
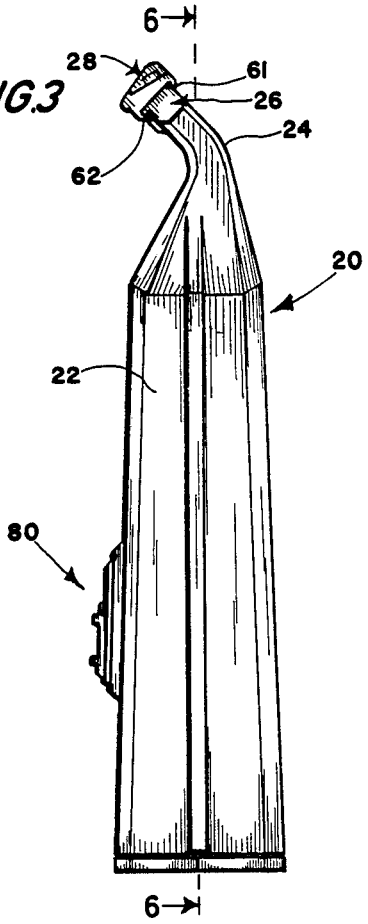
FIG. 3 is a side elevational view thereof.
Figure 4:
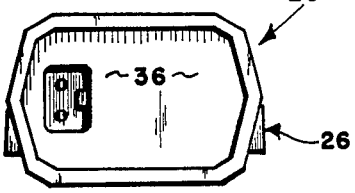
FIG. 4 is a bottom plan view thereof.

As best viewed in FIG. 7, receptacle 26 is secured integrally at its midpoint with neck 24. This receptacle 26 includes a pair of spaced-apart, channel-like flanges 61 and 62, separated by an internal channel 64. Flanges 61 and 62 are adapted to forcibly penetrate the conventional locking groove associated with conventional, removable cartridge blades 28 (FIG. 3).

Figure 2:
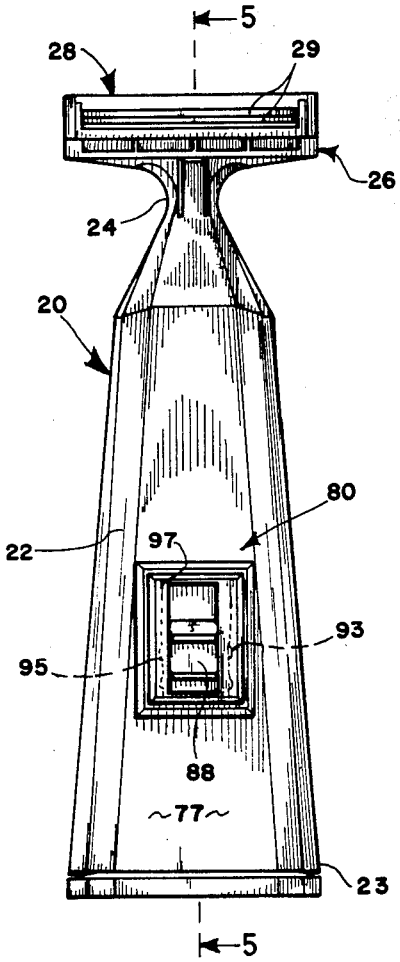
FIG. 2 is a front plan view thereof.

The shaving receptacle 28 includes a pair of spaced-apart blade elements 29 adapted to contact the skin of the user. (FIGS. 2, 7). It will be observed that a typical shaving path as illustrated in FIG. 1 will adequately cut whiskers 67 so as to produce a region of cleanly-shaven skin 68.

Figure 10:
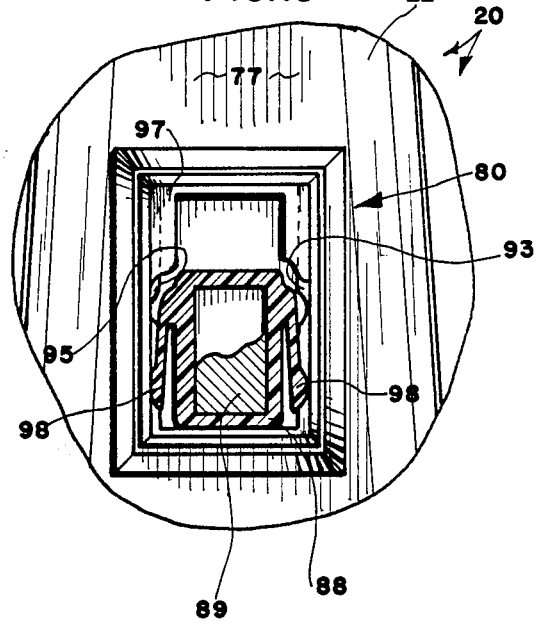
FIG. 10 is an enlarged, fragmentary plan view of the switch circuit thereof, with portions thereof shown in sectional or omitted for clarity.

As best viewed in FIGS. 2, 7, and 10, the shaver 20 is manually activated by operation of a switching system which has been generally designated by the reference numeral 80. The switching system 80 selectively triggers an elongated, internal electrical reed switch 83 which electrically interconnects the battery with the motor 48 (FIG. 7). The electrical circuit will be closed by manipulation of the switch element 88 which moves an associated magnet 89 (FIGS. 5 and 10) over the region occupied by reed switch 83. Switch apparatus 80 is mechanically disposed upon the front surface 77 of the shaver housing 22. The switch element is captured between a pair of channels 93, 95 on opposite sides of its guide assembly 97, and it includes a pair of wing members 98 which snappingly engage within the switch frame 99 so as to prevent removal therefrom. In this manner, the interior of the razor is substantially waterproofed with respect to the exterior.

Figure 5:
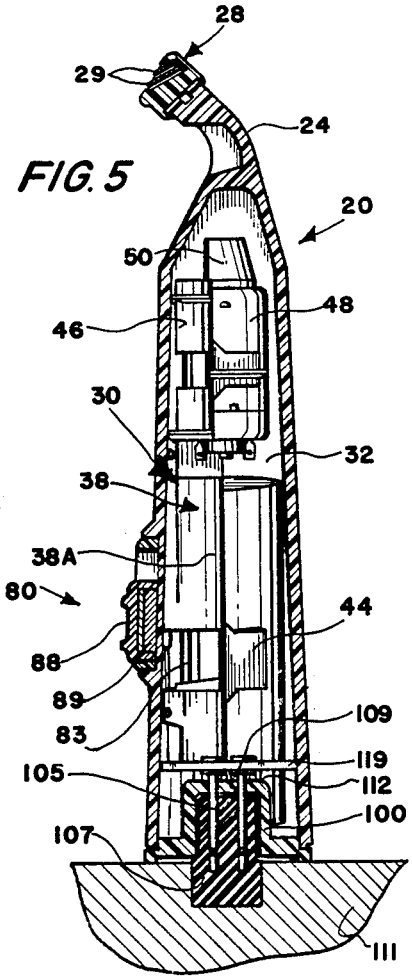
FIG. 5 is a fragmentary, sectional view thereof, taken generally along line 5—5 of FIG. 2 showing a portion of the optional recharger.
Figure 11:
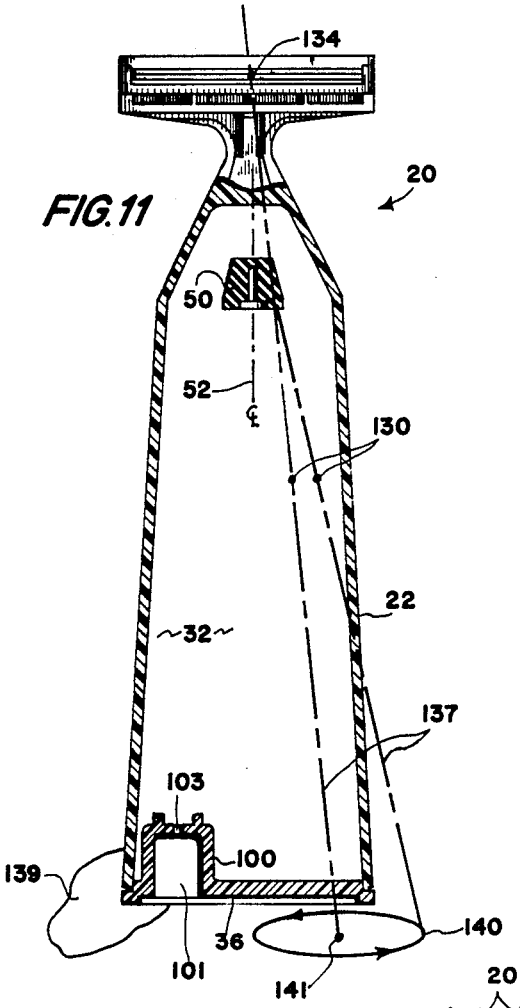
FIG. 11 is a fragmentary, sectional, diagrammatic view thereof.
Figure 12:
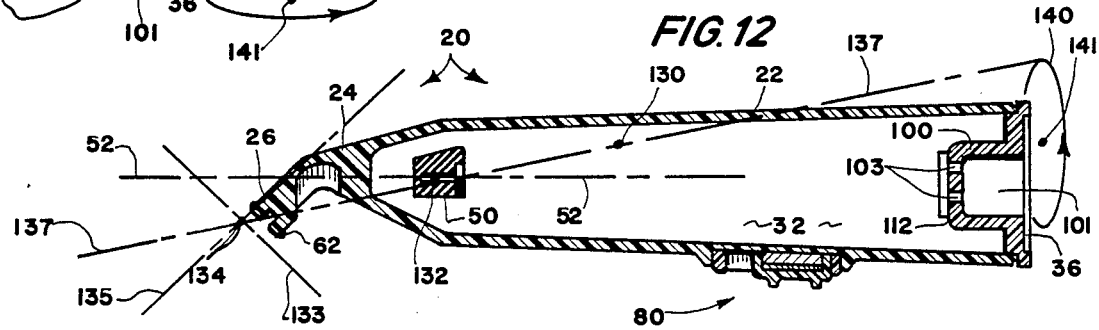
FIG. 12 is a fragmentary, sectional view thereof.

As best viewed in FIGS. 1, 5, 11, and 12, the base 36 of the carriage includes an inwardly projecting boss 100 having an interior cavity 101 which is adapted to communicate with a pair of guide orifices 103 (FIG. 12). Orifices 103 guide and locate suitable electrical prongs 105 (FIG. 1) which are adapted to electrically intercommunicate with a suitable fitting 107 for recharging the apparatus. Fitting 107 may emanate from a suitable recharging stand, a portion of which is identified generally by the reference numeral 111 (FIGS. 5, 6). Alternatively the fitting 107 may be associated with an extension cord or suitable alternative structure capable of recharging the shaver battery.

As best viewed in FIG. 5, when the carriage assembly 30 is interfitted with the housing 22, electrical charge pins 105 will be captured and aligned through orifices 103 (FIG. 12) and suitable O-rings or seals 109 will be pressed about pins 105 against the upper surface 112 of the recharge boss by an internal planar surface 119 associated with the carriage 30 so as to provide a seal. When it is necessary to recharge the shaver 20, the fitting 107 will be press-fitted into the cavity 101 so as to electrically communicate conventional electrical leads associated with the fitting 107 via pins 105 for recharging in the normal manner.

With primary attention now directed to FIGS. 6, 11, and 12, the longitudinal axis of the housing has been generally designated by the reference numeral 52. This is coincident and coaxial with the axis of eccentric rotation 50. The offset center of gravity of the shaver 20 has been generally designated by the reference numeral 130. The center of mass of the eccentric has been generally designated by the reference numeral 132 (FIG. 12). With the preferred construction a line 137 may be drawn between point 130 and center of mass 132. Line 137 would intersect a hypothetical supporting lower base 139 (FIG. 11) upon the outer edge of a circle 140, the center 141 of which provides the apparent center of rotation of the device 20 if placed in an "on" state and then allowed to rest upon a perfect lower supporting plane 139 (FIG. 11). The ellipse 140 will "wobble" because the eccentric center of mass 132 of course changes as the mass oscillates. Center 141 thus migrates. Line 133 (FIG. 12) is generally parallel to the planes of the cutting blades 29, and line 135 which is perpendicular thereto intersects same at a point 134 which is also intersected by line 137 previously described.

Because of the offset center of mass and the offset center of gravity 130, actual rotation of the device will illustrate roll-couple, as circle 140 has a center 141 which is offset from the longitudinal axis 52 of the device. This results because of the offset in angular disposition of the battery 40. For example, in FIG. 6 it will be noted that the longitudinal axis 150 of battery 40 intersects the longitudinal axis 52 of the handle and it is not coaxial therewith. As a result, an angle 157 is formed, and, as seen in FIG. 12, the resultant center of mass 130 of the apparatus is off-center from the longitudinal axis 52 thereof.

Preferably the shaver 20 operates at rotational velocity limits of 10,000 to 13,000 rpm (167 to 217 Hz.) as the effective speed range for the device. For the average user, an even narrower speed range of 10,800 to 11,500 rpm (180 to 192 Hz.) was found to be best. Moreover, the center of mass is offset with respect to the axis of rotation and this is responsible for part of the unique action of the razor 20. It rocks about an axis that appears not to coincide with either the razor's envelope axis or a related line associated with the center of mass. This motion is attributed herein to "dynamic coupling."

When razor 20 is observed operating under a wide field microscope, tiny specks of dust can be seen to orbit in circular or elliptical paths. In the subject razor, facing the blade 28, the right side orbits in a $0.003 \times 0.004$ inch ellipse that has its major axis along a line from 10 o'clock to 4 o'clock. The particles on the left side appear to trace an almost circular path of approximately the same size. These orbital effects confirm the influence of dynamic coupling.

With reference now directed to FIGS. 13, 14A, and 14B, a mechanical system generally designated by the reference numeral 183 is forced to vibrate at a sinusoidal frequency indicated in FIG. 13. The basic circuit elements are a mass 185, coupled to ground 187 by a shock absorber 188 and a spring 189. In response to forced vibration the transmissibility curves generally indicated by the reference numeral 190 of FIG. 14A are generated. FIG. 14B reveals curves generally indicated by the reference numeral 193 which will be recognized as plots of force ratio, which is actually transmissibility squared. In FIGS. 14A and 14B, resonance has generally been indicated by peaks 195, 196 respectively. The zero-crossing points have been generally designated by the reference numerals 194 and 197, respectively. These occur at the square root of two on the horizontal axis.

With reference to FIG. 15, a curve 198 indicates a "resonance" at a point 199. This curve represents the natural period of a representative shaver which, when translated to the corresponding characteristic frequency (i.e. the inverse), reveals a natural resonant frequency of a sample shaver 20 of approximately 6,500 to 7,500 Hz. In FIG. 16, the vertical axis 170 generally represents blade displacement and it has been obtained from developmental test of a representative shaver wherein a suitable transducer-generated voltage output (millivolts) is represented by the axis 170. Motor speed is designated by horizontal axis 171 and the graphical trace 172 results. Peak apparent efficiency is indicated at peak 173.

This is the range where all of the known prior art devices have operated. We have discovered that this range is not best for optimum comfort. Instead, a preferred range of motor speed operation is generally indicated between points 174 and 175. It is necessary to operate at a speed generally corresponding to points above the square root of two of FIGS. 14A and 14B. It is further necessary to operate below the second harmonic illustrated by peak 176 of FIG. 16.

Figure 17:
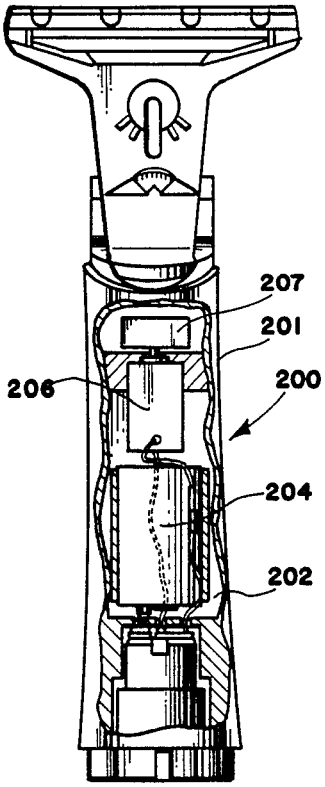
FIG. 17 is a fragmentary, sectional view of the structure of prior art U.S. Pat. No. 3,611,568.
Figure 18:
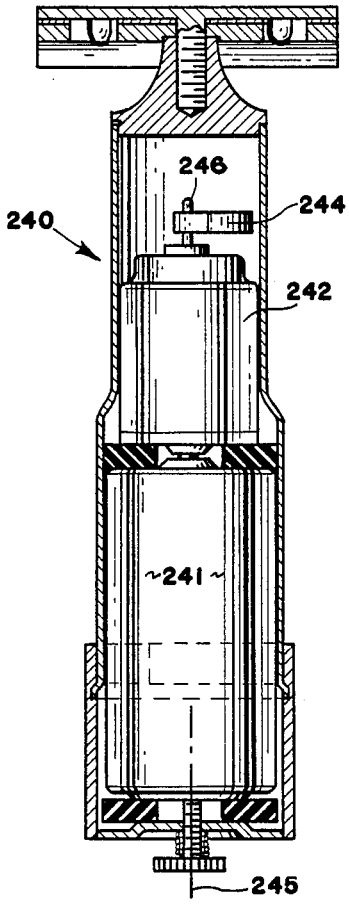
FIG. 18 is an enlarged, fragmentary, sectional view of the structure of prior art U.S. Pat. No. 3,636,627; and, FIG. 19 is an enlarged, fragmentary, sectional view of the structure of prior art U.S. Pat. No. 3,772,779.
Figure 19:
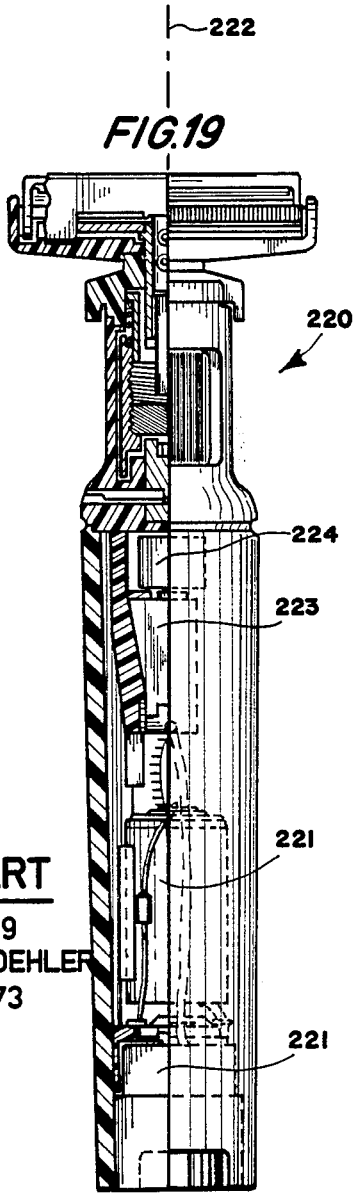

With reference to FIGS. 17–19, prior art devices are shown. For example, Shaver 200 shown in FIG. 17 includes an elongated body 201 having a hollow interior 202 in which suitable battery means 204 are employed to drive a motor 206 to effectuate rotation of an eccentric 207. In this instance, the axis of rotation is coaxial with the longitudinal axis of the device and with the axis of the motor 204. Similarly, FIG. 18 will reveal that internal battery 241 is coaxial with the spaced-apart motor 242 which drives an eccentric 244. Therefore, the axis of rotation established by motor 242 is coaxial with the drive shaft 246. Moreover, the central longitudinal axis of battery 241 is coincident with the longitudinal axis 245 of the unit 240.

Similarly, prior art shaver 220 (FIG. 19) includes internal batteries 221 which are axially aligned and which share and which are coincident with the longitudinal axis 222 of unit 220. Moreover, motor 223 is longitudinally aligned with the longitudinal axis of the device, and eccentric 224 vibrates about an axis of rotation coaxial with the longitudinal axis 222. All of the prior art devices known to us include such a coaxial relationship between the internal mass at the battery and the axis of the device. Such construction results in the lack of a roll-couple as previously described and, if placed upon a table for vibration upon the base thereof, these units would rotate in a virtual perfect circle defining a center coincident with the longitudinal axis thereof.

Moreover, the prior art devices shown in FIGS. 17–19 exhibit insufficient roll-couple to accomplish the objectives of the present invention. Prior art devices such as those discussed above exhibit a near circular orbit throughout the blade area when the device is loosely held. However, when it is held as one would hold it while shaving, the manner of grip greatly influences its motion. Orbits approaching linear motion are common, and the motion is up and down or sideways depending on whether the device is held at the sides or at the top and bottom. When viewed from the side, the motion substantially linear (or perhaps arcuate about a distant instant center).

One of the most dramatic differences in motion of the disclosed razor 20 when compared to prior art devices is its insensitivity to the manner in which it is held. Its motion is approximately the same whether it is gripped from the sides or top and bottom, or whether it is gripped tightly or loosely. The right side moves in a distinct elliptical orbit of consistent size, and the left side exhibits circular motion. This difference in motion is attributed principally to its design emphasis on transmitted force rather than amplitude of motion. The amplitudes of tested prototypes are approximately 0.003 to 0.004 inches. Razor 20 also exhibits a slight elliptical motion into and away from the face.

From the foregoing, it will be seen that this invention is one well adapted to obtain all the ends and objects herein set forth, together with other advantages which are obvious and which are inherent to the structure.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. An oscillating razor for wet shaving comprising:

a rigid, elongated, generally tubular housing having an interior, a longitudinal central axis, a base portion, and a neck spaced apart from said base portion;

a spaced apart receptacle secured to said neck for mounting a standard blade cartridge to facilitate shaving;

eccentric means rotatably disposed within said tubular housing of said razor for vibrating same;

motor means disposed within said housing for rotating said eccentric means, said motor means establishing an axis of rotation generally aligned with with said central axis; and, battery means disposed within said housing for powering said motor means, said battery means having a longitudinal axis which intersects said housing axis within said housing and which defines an acute angle greater than zero degrees between it and said housing axis.

2. The oscillating razor as defined in claim 1 wherein said razor exhibits a natural resonant frequency and the ratio between said motor means rotation frequency and said natural resonant frequency is between 1.414 and 2.0.

3. The razor as defined in claim 2 wherein said razor comprises carriage means supported by said base adapted to mechanically secure said eccentric means, said motor means, and said battery means, said carriage means adapted to be slidably inserted into said housing to seal the interior thereof.

4. The razor as defined in claim 3 including reed switch means associated with said carriage means for selectively electrically interconnecting said battery means with said motor means, said housing including magnetic switch means adapted to be manipulated by a user of said shaver for magnetically actuating said reed switch means to electrically actuate said motor means, and fitting means integrally formed in the base of said carriage means adapted to be electrically coupled to an external recharger circuit for recharging said battery means.

5. The oscillating razor as defined in claim 4 wherein said razor exhibits a natural resonant frequency and the ratio between said motor means rotation frequency and said natural resonant frequency is approximately equal to the square root of two.

6. The oscillating razor as defined in claim 1 wherein said razor exhibits a natural resonant frequency and the ratio between said motor means rotation frequency and said natural resonant frequency is approximately equal to the square root of two.

7. A vibratory razor as defined in claim 1 wherein the mass of the offset battery means establishes a rocking moment through roll couple established by its orientation relative to said longitudinal axis within said housing.

8. An oscillating razor for wet shaving, said razor comprising:

a rigid, elongated, generally tubular housing having an interior, a longitudinal central axis, a base portion, and a neck spaced apart from said base portion;

a spaced apart receptacle secured to said neck for mounting a standard blade cartridge to facilitate shaving;

eccentric means rotatably disposed within said razor housing for vibrating said receptacle;

motor means disposed within said housing for rotating said eccentric means, said motor means establishing an axis of rotation generally coaxial with said central axis;

battery means disposed within said housing for powering said motor means;

said razor is characterized by a natural resonant frequency;

said motor means rotates at a predetermined speed of between 1.414 and 2.0 times said natural resonant frequency thereby establishing a ratio between said motor speed and said natural resonant frequency of between 1.414 and 2.0;

wherein said ratio is approximately equal to the square root of two; and, the longitudinal axis of said battery means interiorly intersects said housing axis and defines an acute angle substantially greater than zero degrees between it and said housing axis.

9. An oscillating razor for wet shaving, said razor comprising:

a rigid, elongated, generally tubular housing having an interior, a longitudinal central axis, a base portion, and a neck spaced apart from said base portion;

a spaced apart receptacle secured to said neck for mounting a standard blade cartridge to facilitate shaving;

eccentric means rotatably disposed within said razor housing for vibrating same;

motor means disposed within said housing for rotating said eccentric means, said motor means establishing an axis of rotation generally coaxial with said central axis; and, battery means disposed within said housing for powering said motor means;

said razor having a center of mass which lies off of said central axis but within said housing, whereby said razor is characterized by a dynamic roll couple;

said razor exhibits a natural resonant frequency and said motor means rotates at a preselected speed; and, the ratio between said motor speed and said natural resonant frequency is between 1.414 and 2.0 and, wherein said battery means comprises an axis which intersects said housing axis interiorly of said housing and which defines an acute angle between it and said housing axis.

10. The razor as defined in claim 9 wherein said razor comprises carriage means supported by said base adapted to mechanically secure said eccentric means, said motor means, and said battery means, said carriage means adapted to be slidably inserted into said housing to seal same, including reed switch means associated with said carriage means for selectively electrically interconnecting said battery with said motor means, said housing including magnetic switch means adapted to be manipulated by a user of said shaver for magnetically actuating said reed switch means to electrically actuate said motor means, and fitting means integrally formed in the base of said carriage means adapted to be electrically coupled to a recharger circuit for recharging said battery means.

11. An oscillating razor for wet shaving, said razor exhibiting substantially uniform shaving characteristics independent of the manner of gripping thereof by a shaver, said razor comprising:

a rigid, elongated, generally tubular housing having an interior, a longitudinal central axis, a base portion, and a neck spaced apart from said base portion;

a spaced apart receptacle secured to said neck for mounting a standard blade cartridge to facilitate shaving;

eccentric means rotatably disposed within said razor housing for vibrating same;

motor means disposed within said housing for rotating said eccentric means;

battery means disposed within said housing for powering said motor means;

said razor exhibiting a natural resonant frequency and said motor means adapted to rotate at a preselected speed;

said razor having a center of mass which lies off of said central axis but within said housing, and the ratio between said motor speed and said natural resonant frequency is between 1.414 and 2.0, whereby said razor exhibits a dynamic roll couple; and, wherein said battery means comprises a longitudinal axis which is non-axial with said housing axis and which intersects and defines an acute angle between it and said housing axis within said housing.

12. An oscillating razor for wet shaving, said razor exhibiting a substantially uniform mode of vibration independent of the manner of gripping thereof by a shaver, said razor comprising:

a rigid, elongated, generally tubular housing having an interior, a longitudinal central axis, a base portion, and a neck spaced apart from said base portion;

a spaced apart receptacle secured to said neck for mounting a standard blade cartridge to facilitate shaving;

eccentric means rotatably disposed within said razor housing for vibrating the razor and the cartridge;

motor means disposed within said housing for rotating said eccentric means;

battery means disposed within said housing for powering said motor means, said battery means having a longitudinal axis acutely intersecting said central axis within said housing;

said razor exhibits a natural resonant frequency and said motor means rotates at a preselected speed; and, said razor has a center of mass which lies off of said central axis but within said housing, and the ratio between said motor speed and said natural resonant frequency is between 1.414 and 2.0, whereby said razor exhibits a dynamic roll couple.

* * * * *